US008997518B2

(12) United States Patent
Jang et al.

(10) Patent No.: US 8,997,518 B2
(45) Date of Patent: Apr. 7, 2015

(54) SCROLL COMPRESSOR AND AIR CONDITIONER INCLUDING THE SAME

(71) Applicants: Yonghee Jang, Seoul (KR); Byoungjin Ryu, Seoul (KR); Baikyoung Chung, Seoul (KR); Beomchan Kim, Seoul (KR); Younghwan Ko, Seoul (KR); Byeongsu Kim, Seoul (KR)

(72) Inventors: Yonghee Jang, Seoul (KR); Byoungjin Ryu, Seoul (KR); Baikyoung Chung, Seoul (KR); Beomchan Kim, Seoul (KR); Younghwan Ko, Seoul (KR); Byeongsu Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 146 days.

(21) Appl. No.: 13/644,368

(22) Filed: Oct. 4, 2012

(65) Prior Publication Data

US 2013/0081425 A1 Apr. 4, 2013

(30) Foreign Application Priority Data

Oct. 4, 2011 (KR) ..... 10-2011-0100555

(51) Int. Cl.

| | |
|---|---|
| ***F25B 1/00*** | (2006.01) |
| ***F04C 23/00*** | (2006.01) |
| ***F04C 18/02*** | (2006.01) |
| ***F04C 29/04*** | (2006.01) |
| ***F25B 1/10*** | (2006.01) |

(52) U.S. Cl.

CPC ..... *F04C 23/008* (2013.01); *F04C 18/0292* (2013.01); *F04C 29/042* (2013.01); *F04C 18/0261* (2013.01); *F25B 1/10* (2013.01); *F04C 2270/42* (2013.01); *F25B 2400/13* (2013.01)

(58) Field of Classification Search

CPC .. F24C 18/0292; F24C 23/008; F24C 29/042; F24C 18/0261; F24C 2270/42; F25B 1/10; F25B 2400/13

USPC ..... 62/190, 498, 513, 510; 418/55.1, 55.4, 418/15

See application file for complete search history.

(56) References Cited

U.S. PATENT DOCUMENTS

| | | | | | |
|---|---|---|---|---|---|
| 4,475,360 | A | * | 10/1984 | Suefuji et al. | 62/324.1 |
| 4,676,075 | A | | 6/1987 | Shiibayashi | |
| 4,768,936 | A | * | 9/1988 | Etemad et al. | 418/55.6 |
| 4,958,993 | A | * | 9/1990 | Fujio | 418/55.3 |
| 5,320,505 | A | * | 6/1994 | Misiak et al. | 418/55.1 |
| 5,329,788 | A | * | 7/1994 | Caillat et al. | 62/505 |

(Continued)

FOREIGN PATENT DOCUMENTS

| | | | |
|---|---|---|---|
| CN | 1219648 | A | 6/1999 |
| CN | 102003388 | A | 4/2011 |

(Continued)

*Primary Examiner* — Mohammad M Ali

(74) *Attorney, Agent, or Firm* — McKenna Long & Aldridge LLP

(57) ABSTRACT

The scroll compressor includes a fixed scroll including a first wrap, an orbiting scroll disposed to have a phase difference with respect to the fixed scroll, the orbiting scroll including a second wrap defining a compression chamber together with the first wrap, a suction part to receive a refrigerant into the compressor chamber, a driving shaft to transmit a rotation force to the orbiting scroll, a first injection part disposed in one position of the fixed scroll to introduce a refrigerant into the compression chamber, and a second injection part disposed in another position of the fixed scroll to introduce a refrigerant into the compression chamber, where the second wrap is disposed on the orbiting scroll such that the first injection part is opened to introduce the second refrigerant before the receipt of the first refrigerant through the suction part is completed during the orbiting of the orbiting scroll.

20 Claims, 6 Drawing Sheets

(56) References Cited

U.S. PATENT DOCUMENTS

| | | | | |
|---|---|---|---|---|
| 5,469,716 | A * | 11/1995 | Bass et al. | 62/505 |
| 2005/0097908 | A1* | 5/2005 | Lifson | 62/196.4 |
| 2007/0059193 | A1* | 3/2007 | Maladkar et al. | 418/55.5 |
| 2008/0236179 | A1 | 10/2008 | Ignatiev et al. | |
| 2009/0297379 | A1* | 12/2009 | Stover et al. | 418/55.1 |
| 2010/0129240 | A1* | 5/2010 | Shiibayashi et al. | 417/410.5 |
| 2010/0212352 | A1* | 8/2010 | Kim et al. | 62/498 |
| 2010/0303659 | A1* | 12/2010 | Stover et al. | 418/24 |
| 2011/0113808 | A1 | 5/2011 | Park et al. | |

FOREIGN PATENT DOCUMENTS

| | | | |
|---|---|---|---|
| EP | 0725255 | A2 | 8/1996 |
| EP | 0922860 | A1 | 6/1999 |
| JP | 2553044 | | 5/1992 |
| JP | 05-180182 | | 7/1993 |
| JP | 10-037868 | A | 2/1998 |
| JP | 2009-036140 | | 2/2009 |
| KR | 10-2011-0054818 | | 5/2011 |

* cited by examiner

Related Art

SCROLL COMPRESSOR AND AIR CONDITIONER INCLUDING THE SAME

CROSS-REFERENCE TO RELATED APPLICATIONS

The present application claims priority under 35 U.S.C. 119 and 35 U.S.C. 365 to Korean Patent Application No. 10-2011-0100555 filed on Oct. 4, 2011, which is hereby incorporated by reference in its entirety.

BACKGROUND

The present disclosure relates to a scroll compressor and an air conditioner including the same.

Air conditioners are home appliances that maintain indoor air into a desired state according to use and purpose thereof. For example, such an air conditioner controls indoor air into a cold state during summer and controls indoor air into a warm state during winter. Furthermore, the air conditioner controls humidity of the indoor air and purifies the indoor air to become a pleasant and clean state.

In detail, the air conditioner has a refrigeration cycle in which compression, condensation, expansion, and evaporation processes of a refrigerant are performed. Thus, a cooling or heating operation of the air conditioner may be performed to cool or heat the indoor air according to the refrigeration cycle.

Such an air conditioner may be classified into a split type air conditioner in which indoor and outdoor units are separated from each other and an integral type air conditioner in which indoor and outdoor units are integrally coupled to each other as a single device, according to whether the indoor and outdoor units are separated from each other.

The outdoor unit includes an outdoor heat exchanger heat-exchanging with external air, and the indoor unit includes an indoor heat exchanger heat-exchanging with indoor air. The air conditioner may be operated in a cooling mode or a heating mode based on the mode selected.

When the air conditioner is operated in the cooling mode, the outdoor heat exchanger serves as a condenser, and the indoor heat exchanger servers as an evaporator. On the other hand, when the air conditioner is operated in the heating mode, the outdoor heat exchanger serves as an evaporator, and the indoor heat exchanger serves as a condenser.

FIG. 6 is a pressure-enthalpy (p-h) diagram of a refrigerant cycle according to a related art. Referring to FIG. 6, a refrigerant is introduced into a compressor in a state "a". Then, the refrigerant is compressed in the compressor and discharged in a state "b". Thereafter, the refrigerant is introduced into a condenser. The refrigerant in the state "b" may be in a liquid phase.

Then, the refrigerant is condensed in the condenser and discharged in a state "c". Thereafter, the refrigerant is throttled in an expansion device, and thus is changed into a state "d", i.e., a two-phase state. The refrigerant throttled in the expansion device is introduced into an evaporator. Then, the refrigerant is heat-exchanged during evaporation, and thus is changed into the state "a". The refrigerant in the state "a" may be in a gaseous phase. Thus, the gaseous refrigerant is introduced into the compressor. The above-described refrigerant cycle is repeatedly performed.

According to the related art, cooling or heating performance may be limited.

In detail, when an external air condition is severe, that is, external air around an area on which the air conditioner is installed has a very high or low temperature, sufficient refrigerant circulation amount should be secured so as to obtain desired cooling/heating performance.

For this, a compressor having large capacity should be provided so as to increase performance of the compressor. In this case, there is a limitation in that manufacturing or installation costs of the air conditioner are increased.

In addition, when the refrigerant discharged from the condenser in an overcooled state is desired, that is, overcooling of the refrigerant is desired, even though evaporation performance of the evaporator, i.e., a lower area of a line connecting a point "d" to a point "a" may be increased, it may be difficult to secure the overcooling of the refrigerant in a system of FIG. 6. Thus, it may be difficult to expect performance improvement.

SUMMARY

Embodiments provide a scroll compressor which can increase a flow rate of a refrigerant injected therein and an air conditioner including the scroll compressor.

In one embodiment, a scroll compressor includes: a fixed scroll including a first wrap; an orbiting scroll disposed to have a phase difference with respect to the fixed scroll, the orbiting scroll including a second wrap defining a compression chamber together with the first wrap; a suction part to receive a refrigerant into the compressor chamber; a driving shaft to transmit a rotation force to the orbiting scroll; a first injection part disposed in one position of the fixed scroll to introduce the refrigerant into the compression chamber; and a second injection part disposed in another position of the fixed scroll to introduce a refrigerant into the compression chamber, where the second wrap is disposed on the orbiting scroll such that the first injection part is opened to introduce the second refrigerant before the receipt of the first refrigerant through the suction part is completed during the orbiting of the orbiting scroll.

In another embodiment, an air conditioner includes: a scroll compressor to compress a refrigerant; a condenser to condense the refrigerant compressed in the scroll compressor; a second injection passage to bypass at least one portion of the refrigerant discharged from the condenser and introduce the refrigerant into the scroll compressor; a first injection passage to introduce a refrigerant having a pressure less than that of the refrigerant within the second injection passage into the scroll compressor; and an evaporator to evaporate a refrigerant, which is decompressed in an expansion device, of the refrigerant discharged from the condenser, wherein the scroll compressor includes: a refrigerant suction part through which the refrigerant passing through the evaporator is received; a plurality of injection parts connected to the first injection passage and the second injection passage; and an orbiting scroll wrap orbitably disposed to selectively cover at least one of the refrigerant suction part, the first injection passage, and the second injection passage.

The details of one or more embodiments are set forth in the accompanying drawings and the description below. Other features will be apparent from the description and drawings, and from the claims.

DETAILED DESCRIPTION OF THE EMBODIMENTS

Hereinafter, exemplary embodiments will be described with reference to the accompanying drawings. The invention may, however, be embodied in many different forms and should not be construed as being limited to the embodiments set forth herein; rather, that alternate embodiments included in other retrogressive inventions or falling within the spirit and scope of the present disclosure will fully convey the concept of the invention to those skilled in the art.

Figure 1:
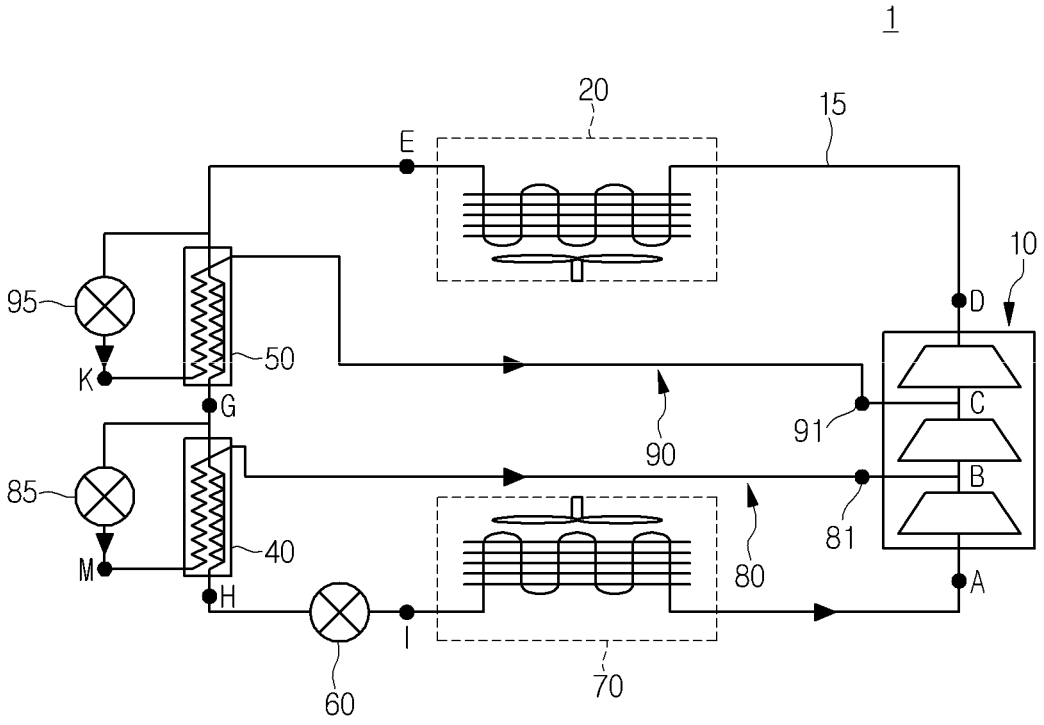
FIG. 1 is a system view of an air conditioner according to an embodiment.
Figure 2:
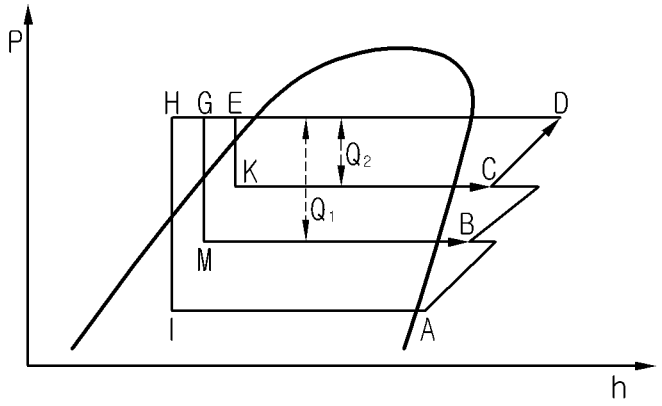
FIG. 2 is a pressure-enthalpy (P-H) diagram of a refrigerant system depending on an operation of the air conditioner according to an embodiment.

FIG. 1 is a system view of an air conditioner according to an embodiment. FIG. 2 is a pressure-enthalpy (P-H) diagram of a refrigerant system depending on an operation of the air conditioner according to an embodiment.

Referring to FIGS. 1 and 2, an air conditioner 1 according to an embodiment has a refrigeration cycle in which a refrigerant is circulated. The air conditioner 1 may perform a cooling or heating operation according to a circulation direction of the refrigerant.

The air conditioner 1 includes a compressor 10 for compressing the refrigerant, a condenser 20 for condensing the refrigerant compressed in the compressor 10, an expansion device 60 for decompressing the refrigerant condensed in the condenser 20, an evaporator 70 for evaporating the refrigerant passing through the expansion device 60, and a refrigerant tube 15 connecting the above-described components to each other to guide a flow of the refrigerant.

The compressor 10 may perform multi-stage compression. The compressor 10 may be a scroll compressor in which a refrigerant is compressed by a relative phase difference between a fixed scroll and an orbiting scroll. Descriptions relating to the above-described structure will be described later.

The air conditioner 1 includes a plurality of overcooling devices 40 and 50 for overcooling a refrigerant passing through the condenser 20. The plurality of overcooling devices 40 and 50 include a second overcooling device 50 for overcooling the refrigerant passing through the condenser 20 and a first overcooling device 40 for overcooling the refrigerant passing through the second overcooling device 50.

The air conditioner 1 includes a second injection passage 90 for bypassing at least one portion of the refrigerant passing through the condenser 20 and a second injection expansion part 95 disposed in the second injection passage 90 to adjust an amount of bypassed refrigerant. The refrigerant may be decompressed when the refrigerant passes through the second injection expansion part 95.

The refrigerant bypassed into the second injection passage 90 of the refrigerant passing through the condenser 20 may be called a "first branch refrigerant", and the rest of the refrigerant except for the first branch refrigerant may be called a "main refrigerant". In the second overcooling device 50, the main refrigerant and the first branch refrigerant are heat-exchanged with each other. Here, the main refrigerant represents a refrigerant introduced into the evaporator 70 via the first overcooling device 40.

Since the first branch refrigerant is changed into a low-temperature low-pressure refrigerant while passing through the second injection expansion part 95, the first branch refrigerant absorbs heat when the first branch refrigerant is heat-exchanged with the main refrigerant. Also, the main refrigerant emits heat into the first branch refrigerant. Thus, the main refrigerant may be overcooled. The first branch refrigerant passing through the second overcooling device 50 is injected into the compressor 10 through the second injection passage 90.

The second injection passage 90 includes a second injection part 91 for injecting a refrigerant into the compressor 10. The second injection part 91 is connected to a first point of the compressor 10.

The air conditioner 1 includes a first injection passage 80 for bypassing at least one portion of the refrigerant passing through the second overcooling device 50 and a first injection expansion part 85 disposed in the first injection passage 80 to adjust an amount of bypassed refrigerant. The refrigerant may be decompressed when the refrigerant passes through the first injection expansion part 85.

The refrigerant bypassed into the first injection passage 80 may be called a "second branch refrigerant". In the first overcooling device 40, the main refrigerant and the second branch refrigerant are heat-exchanged with each other.

Since the second branch refrigerant is changed into a low-temperature low-pressure refrigerant while passing through the first injection expansion part 85, the second branch refrigerant absorbs heat when the second branch refrigerant is heat-exchanged with the main refrigerant. Also, the main refrigerant emits heat into the second branch refrigerant. Thus, the main refrigerant may be overcooled. The second branch refrigerant passing through the first overcooling device 40 is injected into the compressor 10 through the first injection passage 80.

The first injection passage 80 includes a first injection part 81 injecting a refrigerant into the compressor and spaced from the second injection part 91. The first injection part 81 is connected to a second point of the compressor 10. That is, the first injection part 81 and the second injection part 91 are respectively connected to positions different from each other at the compressor 10.

The refrigerant passing through the first overcooling device 40, i.e., the main refrigerant, is expanded while passing through the expansion device 60 and then introduced into the evaporator 70.

The pressure-enthalpy (P-H) diagram in the refrigerant system of the air conditioner will be described with reference to FIG. 2.

The refrigerant (at state A) introduced into the compressor 10 is compressed in the compressor 10. Then, the refrigerant is mixed with a refrigerant injected into the compressor 10 through the first injection passage 80. The mixed refrigerant is in a state B. A process in which the refrigerant is compressed from the state A to the state B is called a "first compression".

The refrigerant (at state B) is compressed again, and then the compressed refrigerant is mixed with a refrigerant injected into the compressor 10 through the second injection passage 90. The mixed refrigerant is in a state C. A process in which the refrigerant is compressed from the state B to the state C is called a "second compression".

The refrigerant (at state C) is compressed again, and then is introduced into the condenser 20 in a state D. Thereafter, when the refrigerant is discharged from the condenser 20, the refrigerant is in a state E.

The first branch refrigerant bypassed while passing through the condenser 20 is expanded to a state K while passing through the second injection expansion part 95 and heat-exchanged with a main refrigerant having the state E. In this process, the main refrigerant having the state E is overcooled to a state G. Also, the first branch refrigerant having the state K is injected into the compressor 10, and then is mixed with the refrigerant within the compressor 10. As a result, the refrigerant is in the state C.

The second branch refrigerant bypassed while passing through the second overcooling device 50 is expanded to a state M wile passing through the first injection expansion part 85 and heat-exchanged with the main refrigerant having the state E. In this process, the main refrigerant having the state G is overcooled to a state H. Also, the second branch refrigerant having the state M is injected into the compressor 10, and then is mixed with the refrigerant within the compressor 10. As a result, the refrigerant is in the state B.

The main refrigerant overcooled to a state H is expanded in the expansion device 60 and then introduced into the evaporator 70. Thereafter, the refrigerant is heat-exchanged in the evaporator 70 and introduced into the compressor 10.

In the P-H diagram, a pressure corresponding to a P-H line connecting a point D to a point H may be called a "high pressure", and a pressure corresponding to a P-H line connecting a point C to a point K, i.e., a pressure within the second injection passage 90 may be called a "second middle pressure". Also, a pressure corresponding to a P-H line connecting a point B to a point M, i.e., a pressure within the first injection passage 80 may be called a "first middle pressure", and a pressure corresponding to a P-H line connecting a point A to a point I may be called a "low pressure".

Here, a flow rate Q1 of the refrigerant injected into the compressor 10 through the first injection passage 80 may be proportional to a pressure difference between the high pressure and the first middle pressure. Also, a flow rate Q2 of the refrigerant injection into the compressor 10 through the second injection passage 90 may be proportional to a pressure difference between the high pressure and the second middle pressure. Thus, when the first and second middle pressures are defined with respect to the low pressure side, a flow rate of the refrigerant injected into the compressor 10 may be increased.

Figure 3:
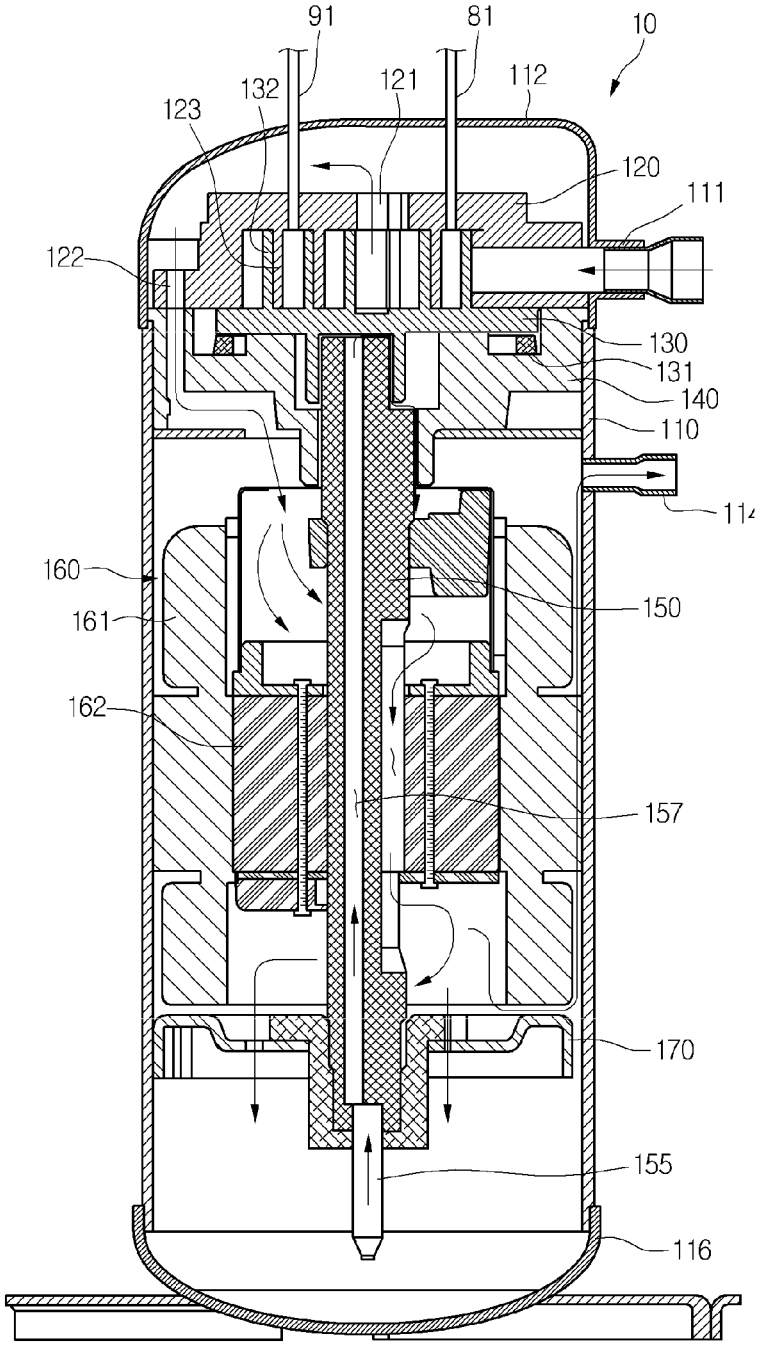
FIG. 3 is a sectional view illustrating a structure of a scroll compressor according to an embodiment.
Figure 4:
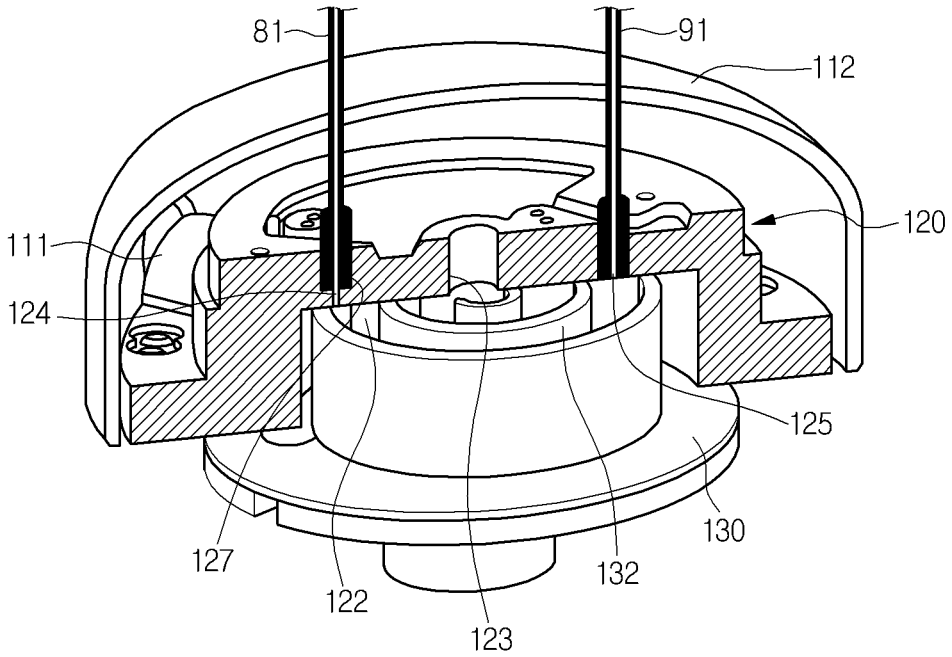
FIG. 4 is a partial view of the scroll compressor according to an embodiment.

FIG. 3 is a sectional view illustrating a structure of a scroll compressor according to an embodiment. FIG. 4 is a partial view of the scroll compressor according to an embodiment.

Referring to FIGS. 3 and 4, the scroll compressor 10 according to an embodiment includes a housing 110 defining an outer appearance thereof, a discharge cover 112 covering an upper side of the housing 110, and a base cover 116 disposed on a lower portion of the housing 110 to store oil. A refrigerant suction part 111 for introducing a refrigerant into the compressor 10 is defined in at least one portion of the discharge cover 112.

The scroll compressor 10 includes a motor 160 received within the housing 110 to generate a rotation force, a rotatable driving shaft 150 passing through a center of the motor 160, a main frame 140 supporting an upper portion of the driving shaft 150, and a compression part disposed above the main frame 140 to compress a refrigerant.

The motor 160 includes a stator 161 coupled to an inner surface of the housing 110 and a rotor 162 rotated within the stator 161. The driving shaft 150 is disposed to pass through a central portion of the rotor 162.

An oil supply passage 157 is eccentrically disposed toward one side at a central portion of the driving shaft 150. Thus, oil introduced into the oil supply passage 157 may ascend by a centrifugal force generated by the rotation of the driving shaft 150.

An oil supply part 155 is coupled to a lower portion of the driving shaft 150. The oil supply part 155 may be integrally rotated together with the driving shaft 150 to move the oil stored in the base cover 116 into the oil supply passage 157.

The compression part includes a fixed scroll 120 disposed on a top surface of the main frame 140 to communicate with the refrigerant suction part 111, orbiting scroll 130 rotatably supported on the top surface of the main frame 140 so that the orbiting scroll 130 is engaged with the fixed scroll 120 to define a compression chamber, and an Oldham's ring disposed between the orbiting scroll 130 and the main frame 140 to prevent the orbiting scroll 130 from being rotated while orbiting the orbiting scroll 130. The orbiting scroll 130 is coupled to the driving shaft 150 to receive the rotation force.

The fixed scroll 120 and the orbiting scroll 130 are disposed so that a phase difference between the fixed scroll 120 and the orbiting scroll 130 is defined at an angle of about 180°. A fixed scroll wrap 123 having a spiral shape is disposed on the fixed scroll 120. Also, an orbiting scroll wrap 132 having a spiral shape is disposed on the orbiting scroll 130. For convenience, the fixed scroll wrap 123 is called a "first wrap", and the orbiting scroll wrap 132 is called a "second wrap". The first wrap 123 and the second wrap 132 are engaged with each other.

The compression chamber may be provided in plurality by engaging the first wrap 123 with the second wrap 132. The orbiting scroll 130 may orbit to compress the refrigerant introduced into the plurality of compression chambers at a high pressure. A discharge hole 121 through which the refrigerant compressed at the high pressure and an oil fluid are discharged is defined in an approximately central portion of an upper portion of the fixed scroll 120.

In detail, when the orbiting scroll 130 orbits, the plurality of compression chambers may be reduced in volume while being moved in a center direction of the compression part toward the discharge hole 121. The refrigerant is compressed within the compression chambers, each having the reduced volume, and then is discharged to the outside of the fixed scroll 120 through the discharge hole 121.

A discharge guide 122 for guiding the high-pressure fluid so that the fluid discharged through the discharge hole 121 descends. The fluid discharged through the discharge guide 122 is introduced into the housing 110 and then discharged through a discharge tube 114. The discharge tube 114 is disposed on a side of the housing 110.

The first and second injection parts 81 and 91 pass through the discharge cover 112 and are coupled to the fixed scroll 120. A first injection hole 124 coupled to the first injection part 81 and a second injection hole 125 coupled to the second injection part 91 are defined in the fixed scroll 120. The first and second injection parts 81 and 91 may be inserted into the injection holes 124 and 125, respectively.

A sealing part 127 for preventing the injected refrigerant from leaking to the outside of the fixed scroll 120 is disposed on each of the first and second injection holes 124 and 125. The sealing part 127 may be disposed to surround each of outer circumference surfaces of the first and second injection parts 81 and 91.

When the orbiting scroll 130 orbits, the orbiting scroll wrap 132 may selectively open or close the refrigerant suction part 111, the first injection hole 124, and the second injection hole 125.

In detail, when the orbiting scroll wrap 132 is located at a first position, the refrigerant suction part 111 is opened. Thus, the refrigerant is introduced into the compressor 10. When the orbiting scroll wrap 132 is located at the first position, the driving shaft 150 may be located at a first angle.

If the orbiting scroll 130 orbits continuously, the orbiting scroll wrap 132 covers the refrigerant suction part 111. Furthermore, the refrigerant within the compression chambers is compressed while the compression chambers are moved. Then, the refrigerant is discharged through the discharge hole 121. As described above, the opening and closing of the refrigerant suction part and the compression process of the refrigerant may be repeatedly performed by the orbiting of the orbiting scroll 130.

In the compression process of the refrigerant, the refrigerant within the injection passages 80 and 90 may be selectively injected into the plurality of compression chambers through the first and second injection parts 81 and 91.

The refrigeration cycle may be changed according to positions of the first and second injection parts 81 and 91.

Here, the positions of the first and second injection parts 81 and 82 may be understood as a concept with respect to whether the injection parts are opened when the orbiting scroll 130 orbits by a certain angle from a time point at which the refrigeration suction through the refrigerant suction part 111 is completed. Also, an orbiting degree of the orbiting scroll 130 may correspond to a rotation degree of the driving shaft 150.

In other words, when the compression is performed somewhat on the basis of a time point at which the refrigerant is sucked through the refrigerant suction part 111, this embodiment defines whether the refrigerant is injected through the first and second injection parts 81 and 91. Hereinafter, detailed descriptions relating to the above-described process will be described with reference to the accompanying drawings.

Figure 5:
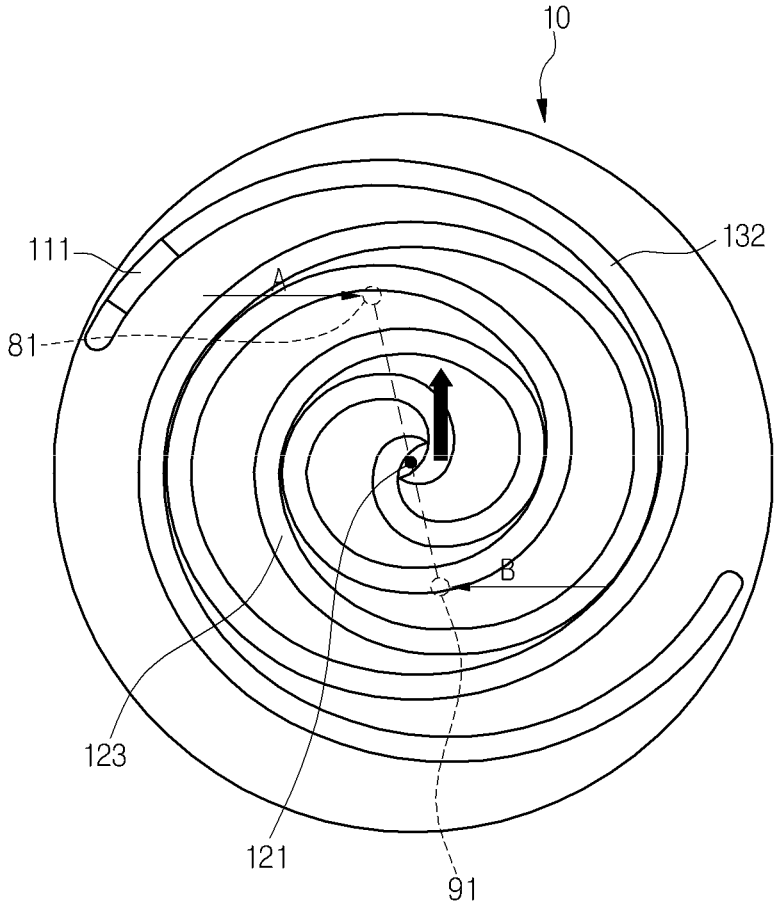
FIG. 5 is a view illustrating an arrangement of a scroll wrap and an injection part in the scroll compressor according to an embodiment.
Figure 6:
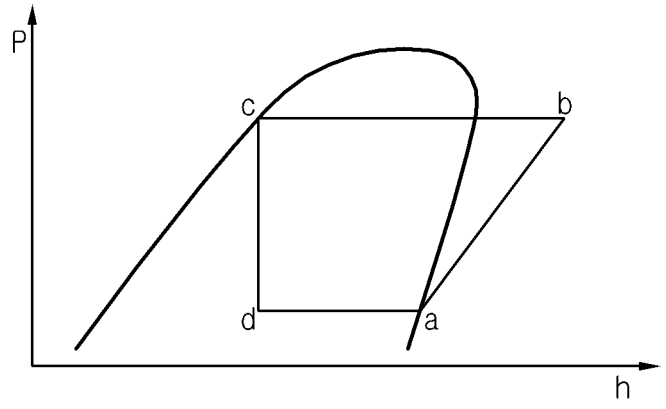
FIG. 6 is a p-h diagram of a refrigerant system depending on an operation of an air conditioner according to a related art.

FIG. 5 is a view illustrating an arrangement of a scroll wrap and an injection part in the scroll compressor according to an embodiment.

Referring to FIG. 5, the orbiting scroll 130 and the fixed scroll 120 according to an embodiment are engaged with each other to define a compression chamber. The orbiting scroll 130 may orbit to move the compression chambers in a center direction of the fixed scroll 120, thereby reducing a volume of each of the compression chamber.

When the orbiting scroll 130 orbits, the refrigerant suction part 111, the first injection part 81, and the second injection part 91 may be successively opened. For example, when one of the refrigerant suction part 111, the first injection part 81, and the second injection part 91 may be opened, the other components may be covered. However, two components may be opened at the same time at a boundary time point at which the components are opened or closed, i.e., at one position of the orbiting scroll 130. This will be described in detail below.

The first injection part 81 and the second injection part 91 may be disposed in one position and in another position of the fixed scroll 120, respectively. For example, a virtual line connecting the first injection part 81 to the second injection part 91 may pass through a center of the fixed scroll 120, i.e., a point corresponding to the discharge hole 121. That is, the first injection part 81 and the second injection part 91 may be disposed facing each other with respect to the discharge hole 121.

When the orbiting scroll 130 orbits, the compression chamber may be moved toward the first injection part 81 or the second injection part 91. Also, the refrigerant may be introduced into the compression chamber through the first injection part 81 or the second injection part 91.

That is, when the compression chamber is located at a position corresponding to the first injection part 81, the refrigerant may be injected through the first injection part 81. Also, when the compression chamber is located at a position corresponding to the second injection part 91, the refrigerant may be injected through the second injection part 91. For example, the corresponding position of the compression chamber may be a position of the compression chamber when the compression chamber is disposed under the first injection part 81 or the second injection part 91.

The first injection hole 124 or the second injection hole 125 may be selectively opened by the orbiting scroll wrap 132. For example, when the first injection hole 124 is opened, the second injection hole 125 may be covered by the orbiting scroll wrap 132. Also, when the second injection hole 125 is opened, the first injection hole 124 may be covered by the orbiting scroll wrap 132. That is, the first and second holes 124 and 125 may be opened at time points different from each other, respectively.

In detail, the opening of the first injection hole 124 may start at a time point at which the suction of the refrigerant through the refrigerant suction part 111 is completed. When the orbiting scroll wrap 132 is moved, the first injection hole 124 may be slowly opened in a predetermined time. That is, the orbiting scroll wrap 132 may be disposed to open the first injection hole 124 before the time point at which the suction of the refrigerant through the refrigerant suction part 111 is completed.

Even though the first injection hole 124 is opened to inject the refrigerant before the suction of the refrigerant through the refrigerant suction part 111 is completed, a time point at which the first injection hole 124 is completely opened to increase an injection amount of refrigerant may be a time point at which the refrigerant suction part 111 is covered or a time point at which the refrigerant is compressed after the refrigerant suction part 111 is covered.

For example, when the time point at which the suction of the refrigerant through the refrigerant suction part 111 is completed, i.e., the time point at which the refrigerant suction part 111 is covered by the orbiting scroll wrap 132 is a time point when the driving shaft 150 has a rotation angle of about 0°, the opening of the first injection hole 124 may start when the driving shaft 150 has a rotation angle of about −10° to about −30°.

Here, when the driving shaft 150 has a rotation angle of about 0°, the suction of the refrigerant is completed. Also, the rotation angle of the driving shaft 150 is increased to an angle of about 10° or about 20° to gradually increase a compression intensity of the refrigerant. Here, the (−) angle represents a time point before the refrigerant suction part 111 is covered.

In summary, the opening of the first injection hole 124 starts before the suction of the refrigerant through the refrigerant suction part 111 is completed. Then, when the driving shaft 150 is further rotated to cover the refrigerant suction part 111 by the orbiting scroll wrap 132, the first injection hole 124 may be completely opened to inject a large amount of refrigerant.

As described above, when the injection amount of refrigerant through the first injection hole 124 is increased at a time point at which the suction of the refrigerant into the compressor 10 is completed, the first middle pressure is lowered in the P-H diagram. Accordingly, the injection amount of refrigerant may be increased.

The refrigerant injected through the first injection hole 124 is mixed with the refrigerant within the compressor 10 and compressed in two stages.

When the driving shaft 150 is further rotated by an angle of about 180° on the basis of a rotation angle (or a rotation angle of the orbiting scroll wrap 132) thereof from the time point at which the opening of the first injection hole 124 starts, the opening of the second injection hole 125 may start.

For example, if the opening of the first injection hole 124 starts at an angle of about −20°, when the driving shaft 150 has a rotation angle of about 160° by further rotating by an angle of about 180°, the opening of the second injection hole 125 may start. When the second injection hole 125 is opened, the first injection hole 124 may be covered by the orbiting scroll wrap 132.

Also, the two stage compression is performed in the compressor 10 during the period in which the driving shaft 150 is further rotated by an angle of about 180°. The time point at which the opening of the second injection hole 125 starts may be a time point at which the two stage compression is completed.

When the driving shaft 150 is further rotated by a predetermined angle from the time point at which the opening of the second injection hole 125 starts, the second injection hole 125 may be completely opened to increase an injection amount of refrigerant. At this time, the two stage compression may be completed.

The refrigerant injected through the second injection hole 125 is mixed with the refrigerant within the compressor 10 and compressed in three stages. The refrigerant compressed in the three stages may be discharged to the outside of the fixed scroll 120 through the discharge hole 121.

When the driving shaft 150 is further rotated by an angle of about 180° on the basis of a rotation angle thereof from the time point at which the opening of the second injection hole 125 starts. The first injection hole 124 may be opened. That is, in an embodiment, when the driving shaft 150 has a rotation angle of about 340°, i.e., is rotated at an angle of about −20° on the basis of about 360° for one time, the first injection hole 124 may be opened.

As described above, since the refrigerant is injected through the first injection passage 80 in earnest to correspond to the time point at which the suction of the refrigerant into the compressor 10 is completed, the first middle pressure may be lowered. Thus, the injection amount of refrigerant may be increased.

Also, since the refrigerant is injected through the second injection passage 90 in earnest to correspond to the time point at which the two stage compression is completed, the second middle pressure may be lowered. Thus, the injection amount of refrigerant may be increased.

Another embodiment will now be described.

Although the plurality of overcooling devices are provided to inject the refrigerant for generating the middle pressure in FIG. 1, the present disclosure is not limited thereto. For example, at least one of the plurality of overcooling devices may be replaced as a phase separator. The phase separator may be a device which separates at least one portion of a gaseous refrigerant from a refrigerant having a two-phase state to inject the gaseous refrigerant into the compressor.

The gaseous refrigerant separated by the phase separator may be injected into the compressor 10 through the first injection passage 80 and then compressed in two stages, or the gaseous refrigerant separated by the phase separator may be injected into the compressor 10 through the second injection passage 90 and then compressed in three stages.

According to the embodiments, since the refrigerant is injected into positions different from each other of the scroll compressor, the refrigerant circulation amount in the system may be increased to improve the cooling/heating performance.

Since the refrigerant generating the middle pressure is injected into the compressor, a power required for compressing the refrigerant in the compressor may be reduced to improve the cooling/heating efficiency.

Also, since the opening of the first injection part starts before the suction of the refrigerant into the compressor through the refrigerant suction part is completed, the injection of the refrigerant may be performed in earnest at the time point at which the refrigerant is compressed after the suction of the refrigerant is completed. That is, since a large amount of refrigerant is injected at the time point at which the refrigerant is compressed, a pressure (the middle pressure) of the injected refrigerant may be lowered to increase a flow rate of the injected refrigerant.

Also, since the first and second injection parts, which have a predetermined phase difference therebetween, are provided in the compressor to optimize the opening/closing time points of the first and second injection parts, the refrigerant may be effectively injected and compressed.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor comprising:

a fixed scroll comprising a first wrap;

an orbiting scroll disposed to have a phase difference with respect to the fixed scroll, the orbiting scroll comprising a second wrap defining a compression chamber together with the first wrap;

a suction part to receive a first refrigerant into the compressor chamber;

a driving shaft to transmit a rotation force to the orbiting scroll;

a first injection part disposed in one position of the fixed scroll to introduce a second refrigerant into the compression chamber; and a second injection part disposed in another position of the fixed scroll to introduce a third refrigerant into the compression chamber, wherein the second wrap is disposed on the orbiting scroll such that the first injection part is opened to introduce the second refrigerant before the receipt of the first refrigerant through the suction part is completed during the orbiting of the orbiting scroll, wherein the opening of the first injection part allows the second refrigerant injected through the first injection part to be mixed with a first refrigerant compressed in a first stage of the compression chamber and the second wrap is moved such that the mixed first and second refrigerants re compressed in a second stage of the compression chamber.

2. The scroll compressor according to claim 1, wherein the second wrap moves to cover at least one of the suction part, the first injection part, and the second injection part during the orbiting of the orbiting scroll.

3. The scroll compressor according to claim 2, wherein when one of the first and second injection parts is opened, a portion of the second wrap covers the other injection part during the movement of the second wrap.

4. The scroll compressor according to claim 1, wherein a discharge hole through which the first, second, and third refrigerant compressed in the compression chamber is discharged is positioned in a central portion of the fixed scroll, and a virtual line connecting the first injection part to the second injection part passes through the discharge hole.

5. The scroll compressor according to claim 1, wherein the first injection part is positioned at the fixed scroll in which the opening of the first injection part starts before the suction part is opened and then covered by the second wrap.

6. The scroll compressor according to claim 5, wherein, when the driving shaft has a rotation angle of about 0° at a time point at which the receipt of the refrigerant through the suction part is completed, the opening of the first injection part starts when the driving shaft has a rotation angle of about −10° to about −30°.

7. The scroll compressor according to claim 1, wherein the second injection part is positioned at the fixed scroll in which opening of the second injection part starts before the second stage compression of the compression chamber is completed.

8. The scroll compressor according to claim 1, wherein, when the driving shaft is further rotated by an angle of about 180° after the opening of the first injection part starts, the opening of the second injection part starts.

9. The scroll compressor according to claim 1, further comprising a discharge cover to cover an upper side of the fixed scroll, wherein the first and second injection parts pass through the discharge cover and are coupled to the fixed scroll.

10. The scroll compressor according to claim 9, wherein the discharge cover comprises:

a first injection hole in which the first injection part is inserted;

a second injection hole in which the second injection part is inserted;

a first sealing part disposed inside of the first injection hole to surround an outer circumference of the first injection part; and a second sealing part disposed inside of the second injection hole to surround an outer circumference surface of the second injection part.

11. An air conditioner comprising:

a scroll compressor to compress a refrigerant;

a condenser to condense the refrigerant compressed in the scroll compressor;

a second injection passage to bypass at least one portion of the refrigerant discharged from the condenser and introduce the at least one portion of the refrigerant into the scroll compressor;

a first injection passage to introduce a refrigerant having a pressure less than that of the at least one portion of the refrigerant within the second injection passage into the scroll compressor;

an expansion device to decompress the refrigerant discharged from the condenser;

an evaporator to evaporate the refrigerant decompressed by the expansion device; and a plurality of overcooling devices for overcooling the refrigerant passing through the condenser and including a first overcooling device heat-exchanged with the refrigerant within the first injection passage and a second overcooling device heat-exchanged with the refrigerant within the second injection passage, wherein the scroll compressor comprises:

a refrigerant suction part through which the refrigerant passing through the evaporator is received;

a first injection part and a second injection part connected to the first injection passage and the second injection passage, respectively; and an orbiting scroll wrap orbitably disposed to cover at least one of the refrigerant suction part, the first injection passage, and the second injection passage, the orbiting scroll wrap moving such that the first injection part is opened to introduce the refrigerant before the receipt of the refrigerant through the refrigerant suction part is completed.

12. The air conditioner according to claim 11, wherein the scroll compressor further comprises:

a fixed scroll wrap engaged with the orbiting scroll wrap to define a plurality of compression chambers.

13. The air conditioner according to claim 11, wherein the first injection part is disposed in a cover of the scroll compressor; and the second injection part is disposed in the cover of the scroll compressor and spaced apart from the first injection part.

14. The air conditioner according to claim 13, wherein the orbiting scroll wrap is moved to successively open the refrigerant suction part, the first injection part, and the second injection part.

15. The air conditioner according to claim 14, wherein the orbiting scroll wrap is configured such that when the orbiting scroll wrap is moved the opening of the first injection passage starts at a time point before the refrigerant suction part is covered.

16. The air conditioner according to claim 15, when the driving shaft has a rotation angle of about 0° at a time point at which the receipt of the refrigerant through the suction part is completed, the opening of the first injection part starts when the driving shaft has a rotation angle of about −10° to about −30°.

17. The air conditioner according to claim 15, wherein the first injection passage is completely opened when the refrigerant suction part is covered.

18. The air conditioner according to claim 15, wherein opening of the second injection passage starts when the orbiting scroll wrap is further rotated by an angle of about 180° after the opening of the first injection passage starts.

19. A scroll compressor comprising:

a fixed scroll comprising a first wrap;

an orbiting scroll disposed to have a phase difference with respect to the fixed scroll, the orbiting scroll comprising a second wrap defining a compression chamber together with the first wrap;

a suction part to receive a first refrigerant into the compressor chamber;

a driving shaft to transmit a rotation force to the orbiting scroll;

a first injection part disposed in one position of the fixed scroll to introduce a second refrigerant into the compression chamber, the opening of the first injection part starting before the suction part is opened and then covered by the second wrap; and a second injection part disposed in another position of the fixed scroll to introduce a third refrigerant into the compression chamber, wherein the second wrap is disposed on the orbiting scroll such that the first injection part is opened to introduce the second refrigerant before the receipt of the first refrigerant through the suction part is completed during the orbiting of the orbiting scroll, and wherein, when the driving shaft has a rotation angle of about 0° at a time point at which the receipt of the refrigerant through the suction part is completed, the second wrap is arranged such that the opening of the first injection part starts when the driving shaft has a rotation angle of about −10° to about −30°.

20. A scroll compressor comprising:

a fixed scroll comprising a first wrap;

an orbiting scroll disposed to have a phase difference with respect to the fixed scroll, the orbiting scroll comprising a second wrap defining a compression chamber together with the first wrap;

a suction part to receive a first refrigerant into the compressor chamber;

a driving shaft to transmit a rotation force to the orbiting scroll;

a first injection part disposed in one position of the fixed scroll to introduce a second refrigerant into the compression chamber, the opening of the first injection part starting before the suction part is opened and then covered by the second wrap; and a second injection part disposed in another position of the fixed scroll to introduce a third refrigerant into the compression chamber, wherein the second wrap is disposed on the orbiting scroll such that the first injection part is opened to introduce the second refrigerant before the receipt of the first refrigerant through the suction part is completed during the orbiting of the orbiting scroll, and wherein, when the driving shaft is further rotated by an angle of about 180° after the opening of the first injection part starts, the second wrap is arranged such that the opening of the second injection part starts.

* * * * *